US008843031B2

(12) United States Patent
Yamaguchi

(10) Patent No.: US 8,843,031 B2
(45) Date of Patent: Sep. 23, 2014

(54) IMAGE FORMING APPARATUS PROVIDING ACCURATE POSITIONING OF BELT UNIT

(71) Applicant: Wataru Yamaguchi, Nissin (JP)

(72) Inventor: Wataru Yamaguchi, Nissin (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 61 days.

(21) Appl. No.: 13/728,574

(22) Filed: Dec. 27, 2012

(65) Prior Publication Data

US 2013/0195506 A1 Aug. 1, 2013

(30) Foreign Application Priority Data

Jan. 31, 2012 (JP) ..... 2012-018606

(51) Int. Cl.

| | |
|---|---|
| ***G03G 15/16*** | (2006.01) |
| ***G03G 21/16*** | (2006.01) |
| ***G03G 15/14*** | (2006.01) |
| ***G03G 15/01*** | (2006.01) |

(52) U.S. Cl.

CPC ..... *G03G 15/14* (2013.01); *G03G 15/0194* (2013.01); *G03G 21/1647* (2013.01); *G03G 21/168* (2013.01)

USPC ..... 399/121; 399/110

(58) Field of Classification Search

USPC ..... 399/121, 110, 111

See application file for complete search history.

(56) References Cited

U.S. PATENT DOCUMENTS

| | | | | |
|---|---|---|---|---|
| 2007/0009310 | A1* | 1/2007 | Kato | 400/691 |
| 2007/0048005 | A1* | 3/2007 | Nakano et al. | 399/110 |
| 2009/0226212 | A1* | 9/2009 | Hayakawa | 399/124 |
| 2010/0329757 | A1 | 12/2010 | Souda | 399/381 |
| 2011/0158689 | A1* | 6/2011 | Yamaguchi | 399/121 |
| 2011/0200355 | A1* | 8/2011 | Mori et al. | 399/110 |

FOREIGN PATENT DOCUMENTS

| | | | |
|---|---|---|---|
| JP | 2008-129488 | A | 6/2008 |
| JP | 2009-210900 | A | 9/2009 |
| JP | 2010-197770 | A | 9/2010 |
| JP | 2011-13268 | A | 1/2011 |

* cited by examiner

*Primary Examiner* — Sophia S Chen

(74) *Attorney, Agent, or Firm* — Scully, Scott, Murphy & Presser, P.C.

(57) ABSTRACT

An image forming apparatus includes a support frame having a first abutment portion, and a belt unit detachably attachable to the support frame and having a first abutted portion configured to be in contact with the first abutment portion. One of the support frame and the belt unit has a pressing portion, and remaining one of the support frame and the belt unit has a pressed portion pressed by the pressing portion so as to increase a contacting surface pressure between the first abutment portion and the first abutted portion. The pressing portion has a first contacting portion in contact with the pressed portion, and the pressed portion has a second contacting portion in contact with the first contacting portion. The first contacting portion and the second contacting portion are made from an electrically conductive material.

11 Claims, 9 Drawing Sheets

IMAGE FORMING APPARATUS PROVIDING ACCURATE POSITIONING OF BELT UNIT

CROSS REFERENCE TO RELATED APPLICATION

This application claims priority from Japanese Patent Application No. 2012-018606 filed Jan. 31, 2012. The entire content of the priority application is incorporated herein by reference.

TECHNICAL FIELD

The present invention relates to an electro-photographic type image forming apparatus.

BACKGROUND

There is proposed an image forming apparatus including a belt unit provided with a lever member and a spring for positioning the belt unit relative to a chassis of the image forming apparatus. In this image forming apparatus, the belt unit is urged toward the chassis of the image forming device by the lever member and the spring.

SUMMARY

It is an object of the present invention is to provide an image forming apparatus capable of positioning a belt unit with a novel structural design.

In order to achieve this and other objects of the present invention, there is provided an image forming apparatus including a photosensitive drum configured to carry thereon a developing agent image; a stationary support frame having a first abutment portion; and a belt unit configured to be attached to and detached from the support frame. The belt unit includes: a transfer unit configured to transfer the developing agent image carried on the photosensitive drum to a target; and an endless belt circularly movable and positioned between the transfer unit and the photosensitive drum. The belt unit has a first abutted portion configured to be in contact with the first abutment portion so as to perform positioning of the belt unit with respect to the support frame. One of the support frame and the belt unit has a pressing portion, and remaining one of the support frame and the belt unit having a pressed portion pressed by the pressing portion so as to increase a contacting surface pressure between the first abutment portion and the first abutted portion. The pressing portion has a first contacting portion configured to be in contact with the pressed portion, and the pressed portion has a second contacting portion configured to be in contact with the first contacting portion, the first contacting portion and the second contacting portion being made from an electrically conductive material.

BRIEF DESCRIPTION OF THE DRAWINGS

The particular features and advantages of the invention as well as other objects will become apparent from the following description taken in connection with the accompanying drawings, in which.

DETAILED DESCRIPTION

<First Embodiment>

An electro-photographic type color printer 1 as an example of an image forming apparatus according to a first embodiment of the present invention will be described with reference to FIGS. 1 to 7.

Figure 1:
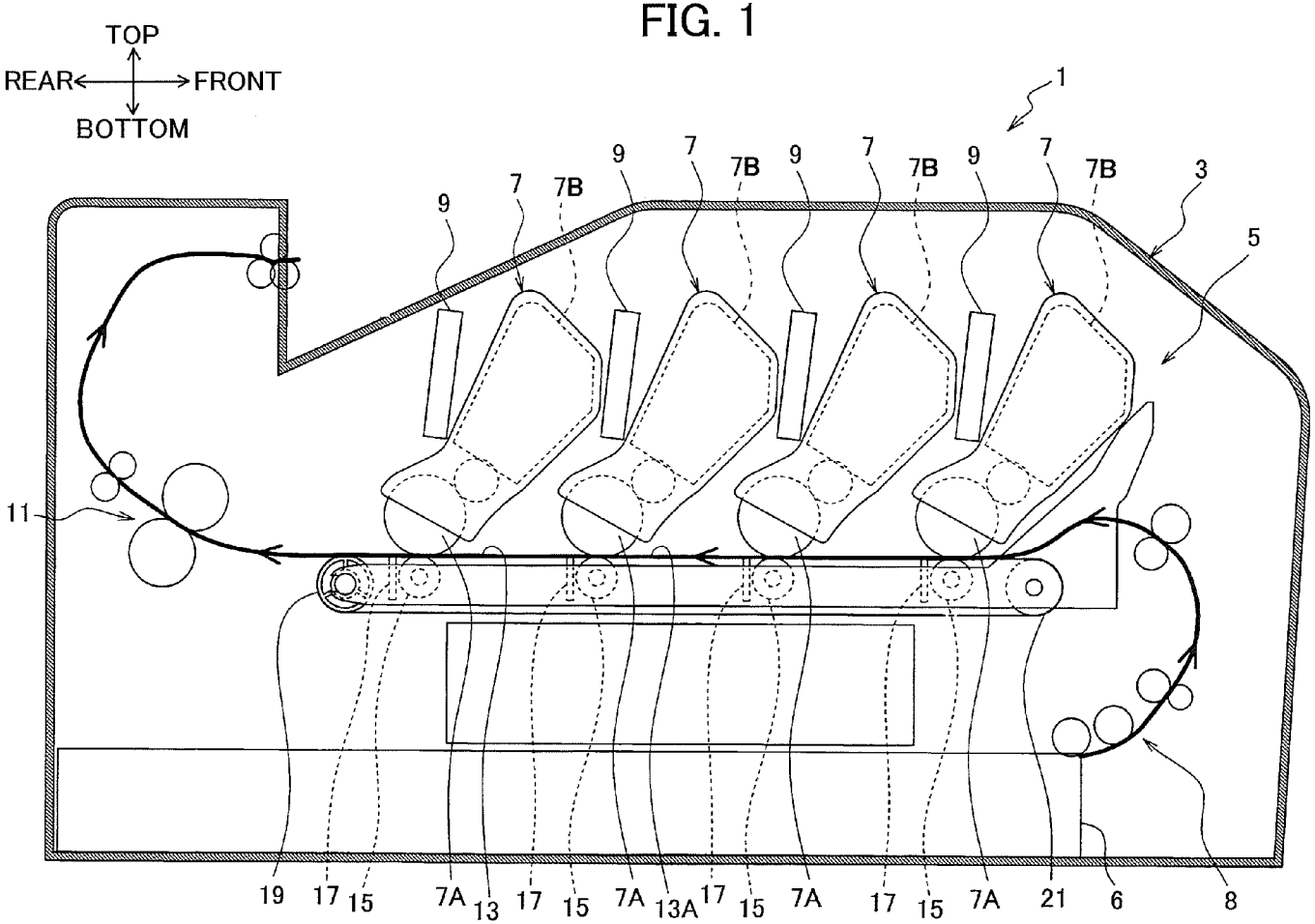
FIG. 1 is a schematic cross-sectional view of an image forming apparatus according to a first embodiment of the present invention.

Throughout the specification, the terms "upward", "downward", "upper", "lower", "above", "below", "beneath", "right", "left", "front", "rear" and the like will be used assuming that the color printer 1 is disposed in an orientation in which it is intended to be used. In use, the color printer 1 is disposed as shown in FIG. 1. Specifically, in FIG. 1, a right side, a left side, a near side and a far side of the laser printer 1 are referred to as a front side, a rear side, a left side and a right side, respectively. Further, the top and bottom of the color printer 1 will be based on a vertical direction in FIG. 1.

1. Overall Structure of the Printer

The color printer 1 has a casing 3 in which an image forming unit 5 is provided. The image forming unit 5 includes four process units 7, four exposure units 9 and a fixing unit 11. The image forming unit 5 is configured to form a visible image on a sheet by transferring developing agent (toner) to a sheet and fix the developing agent to the sheet. The image forming unit 5 is of a direct tandem type where a plurality of process units 7 (four process units 7) are arrayed in series in a sheet conveying direction (front-rear direction in the embodiment).

Each process unit 7 has a structure substantially identical to one another, while a color of the developing agent is different from one another. More specifically, each process unit 7 includes a photosensitive drum 7A configured to carry a developing agent image, and a container 7B configured to accommodate therein the developing agent.

A transfer belt 13 extends in a direction of the array of the process units 7 at a position immediately therebelow (front-rear direction in the embodiment). A plurality of transfer portions 15 (four transfer portions 15) such as transfer rollers are positioned below the corresponding process units 7, respectively such that the transfer belt 13 is positioned between each process unit 7 and each transfer portion 15, and is configured to circularly move. Each transfer portion 15 is configured to transfer the developing agent image carried on each photosensitive drum 7A onto the sheet conveyed on the transfer belt 13 such that each developing agent image is superimposed with each other one after another.

Each transfer portion 15 is applied with a bias voltage for transferring the developing agent image carried on the photosensitive drum 7A to the sheet. A neutralization member or an eraser 17 is provided at a position adjacent to each transfer portion 15 for removing electric potential applied to the transfer belt 13. The neutralization member 17 is of brush-like or saw-teeth like fashion. The transfer portions 15, the neutralization members 17 and the transfer belt 13 are provided in a belt unit 25 described later.

A sheet supply tray 6 for accommodating a stack of sheets is disposed below the belt unit 25. The sheet supply tray 6 is detachably mounted in the casing 3. A sheet supplying mechanism 8 is provided for supplying each one of the sheet of the sheet stack to the image forming unit 5.

2. Belt Unit 2.1 Detailed Structure of the Belt Unit

Figure 2:
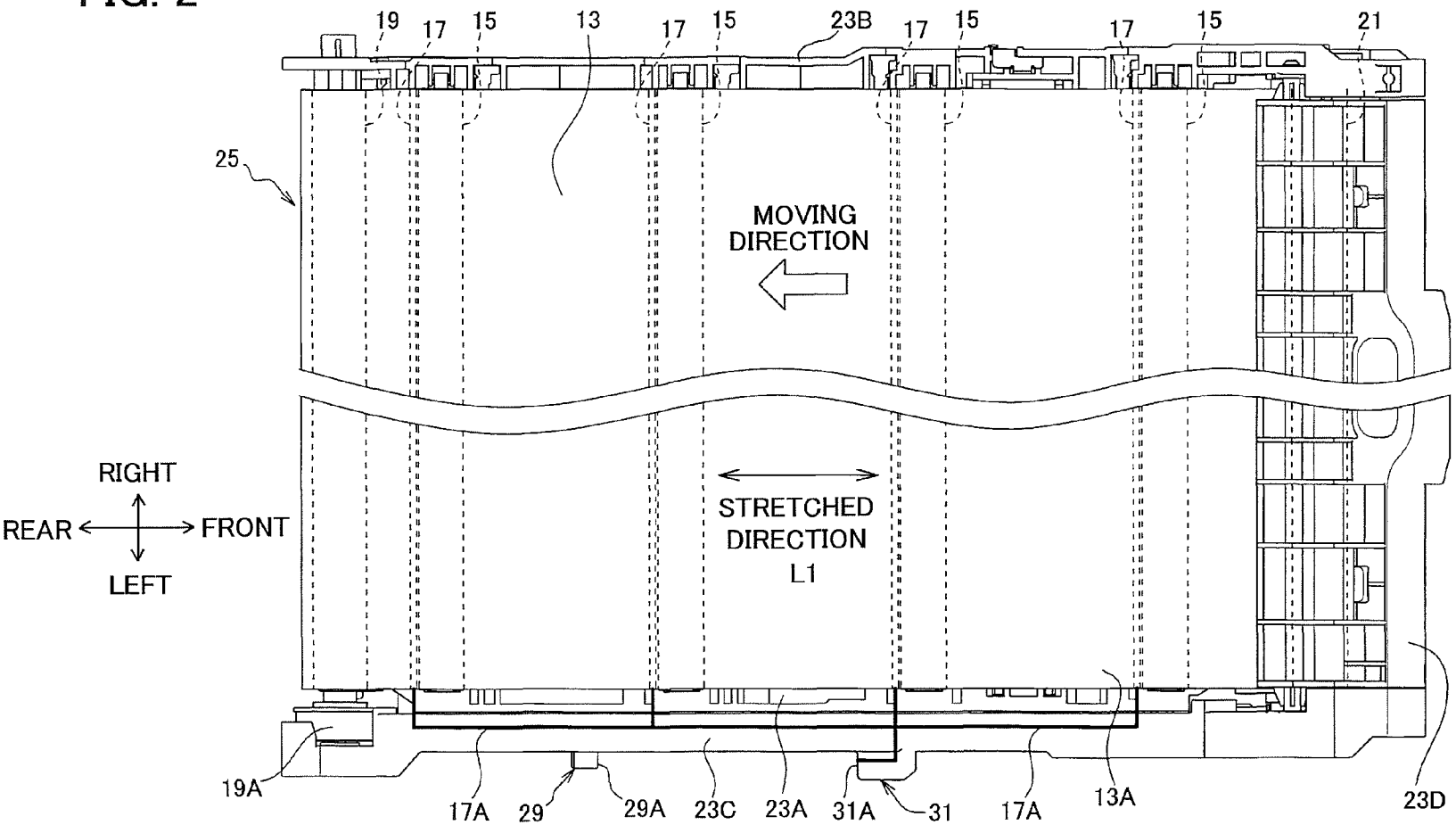
FIG. 2 is a plan view of a belt unit in the image forming apparatus according to the first embodiment.

As shown in FIG. 2, the belt unit 25 includes the transfer belt 13, the neutralization members 17, a drive roller 19, a follower roller 21, and a plate-like main frame 23A supporting these components.

The transfer belt 13 is an endless belt stretchedly mounted over the drive roller 19 and the follower roller 21, and is circularly moved upon rotation of the drive roller 19. The follower roller 21 is rotated by the rotation of the drive roller 19 through the transfer belt 13. The drive roller 19 has an axis extending in an axial direction that is coincident with a left-right direction of the color printer 1. The axial direction is also parallel to an axial direction of each photosensitive drum 7A.

The transfer belt 13 extends in a stretched direction L1 that is coincident with the front-rear direction in the embodiment. The transfer belt 13 has an upper running portion in direct confrontation with each of the photosensitive drums 7A (see FIG. 1). This upper running portion of the transfer belt 13 will be referred to as a stretched portion 13A, hereinafter. As the transfer belt 13 circularly moves, the stretched portion 13A of the transfer belt 13 moves rearward, as shown in FIGS. 2 and 3.

Here, the stretched direction L1 of the transfer belt 13 implies a direction parallel to a direction of tensile force generating at the stretched portion 13A.

Side frames 23B, 23C extending in the stretched direction L1 are attached to the main frame 23A such that the side frames 23B, 23C oppose each other in the axial direction. Each of the side frames 23B, 23C has one end portion that rotatably supports each axial end portion of the drive roller 19.

Figure 3:
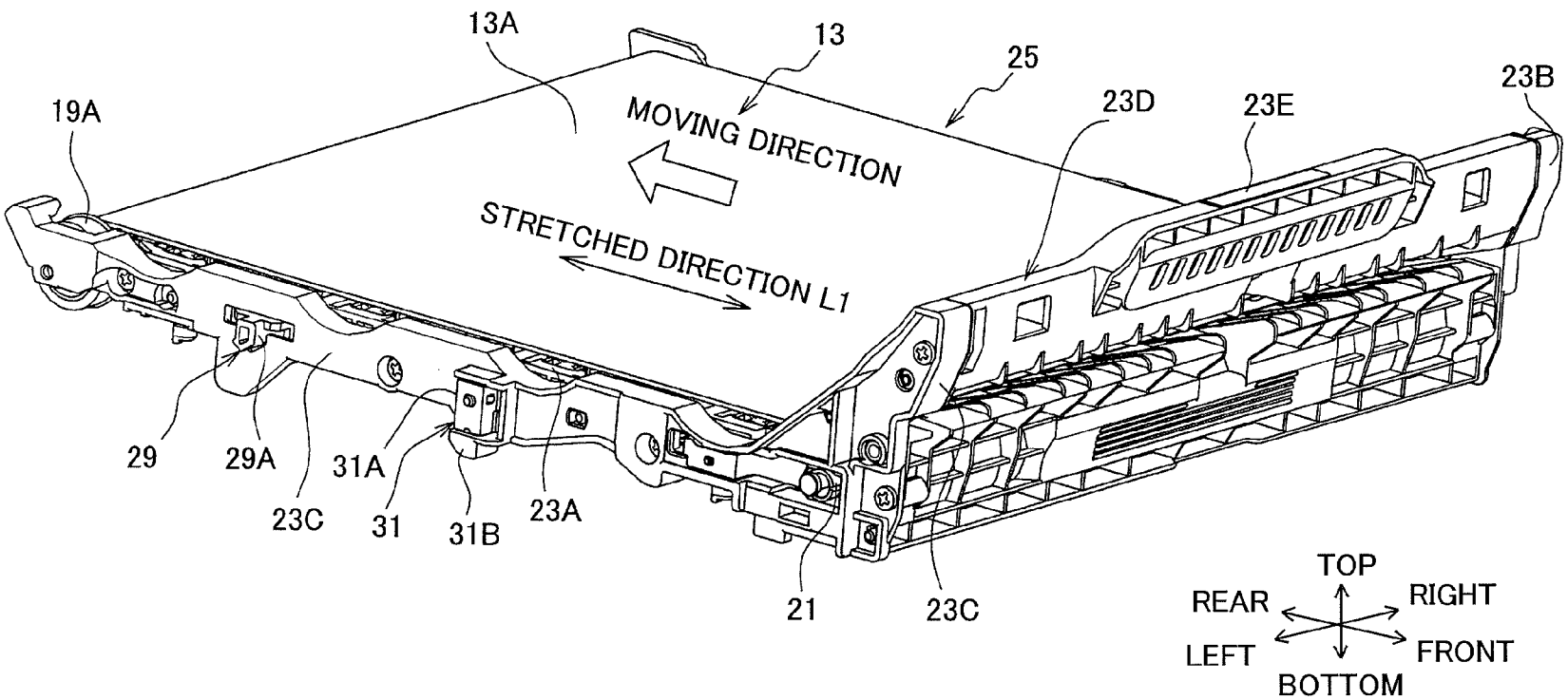
FIG. 3 is a perspective view of the belt unit in the image forming apparatus according to the first embodiment.

As shown in FIG. 3, the side frames 23B, 23C are respectively attached to the main frame 23A by mechanical fasteners such as screw threads. Each of the side frames 23B, 23C has another end portion positioned near the follower roller 21, and a grip frame 23D extending in the axial direction is spanned between the another end portions of the side frames 23B, 23C.

Figure 4:
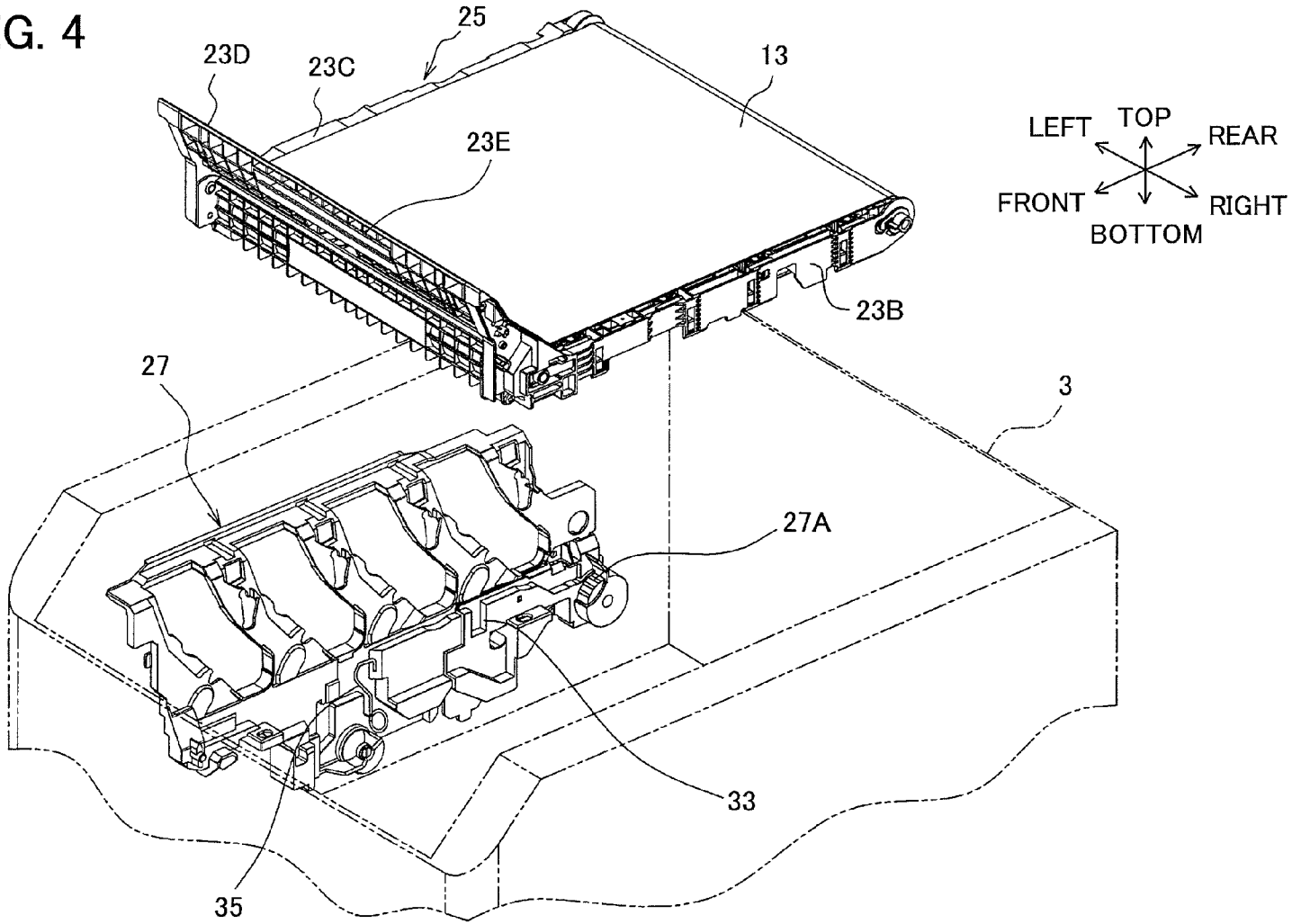
FIG. 4 is a perspective view showing a relationship between the belt unit and a chassis in the image forming apparatus according to the first embodiment.

The grip frame 23D has a grip portion 23E for hand-gripping the belt unit 25. The casing 3 is provided with a pair of support frames 27 (only one of which is shown in FIG. 4), and the belt unit 25 is detachably attachable to the support frames 27 while a user holds the grip portion 23E.

Each support frame 27 is provided at each side wall of the casing 3 (left side wall and right side wall). Therefore, when mounted in the casing 3, the belt unit 25 is bridged over and between the pair of support frames 27. In the following description, the term "support frame 27" will be referred to the support frame 27 near the side frame 23C (on the left side) unless otherwise specified.

As shown in FIG. 3, the side frame 23C has a first abutted portion 29 and a pressed portion 31. The first abutted portion 29 protrudes leftward from the side frame 23C toward the support frame 27, and is integrally formed with the side frame 23C made from a resin.

The pressed portion 31 also protrudes leftward from the side frame 23C toward the support frame 27, and is positioned away from the first abutted portion 29 toward the follower roller 21 in the stretched direction L1 (i.e., frontward of the first abutted portion 29).

The pressed portion 31 has a protruding portion 31 B protruding integrally from the side frame 23C, and a cover plate made from a metal plate. The cover plate is configured to cover at least a side surface of the protruding portion 31B, the side surface in confrontation with the first abutted portion 29 (i.e., rear side surface of the protruding portion 31B in the embodiment). The cover plate covering at least the side surface serves as a pressed surface 31A. As shown in FIG. 2, each neutralization member 17 is electrically connected to the pressed surface 31A via an electrically conductive wire 17A.

Figure 5:
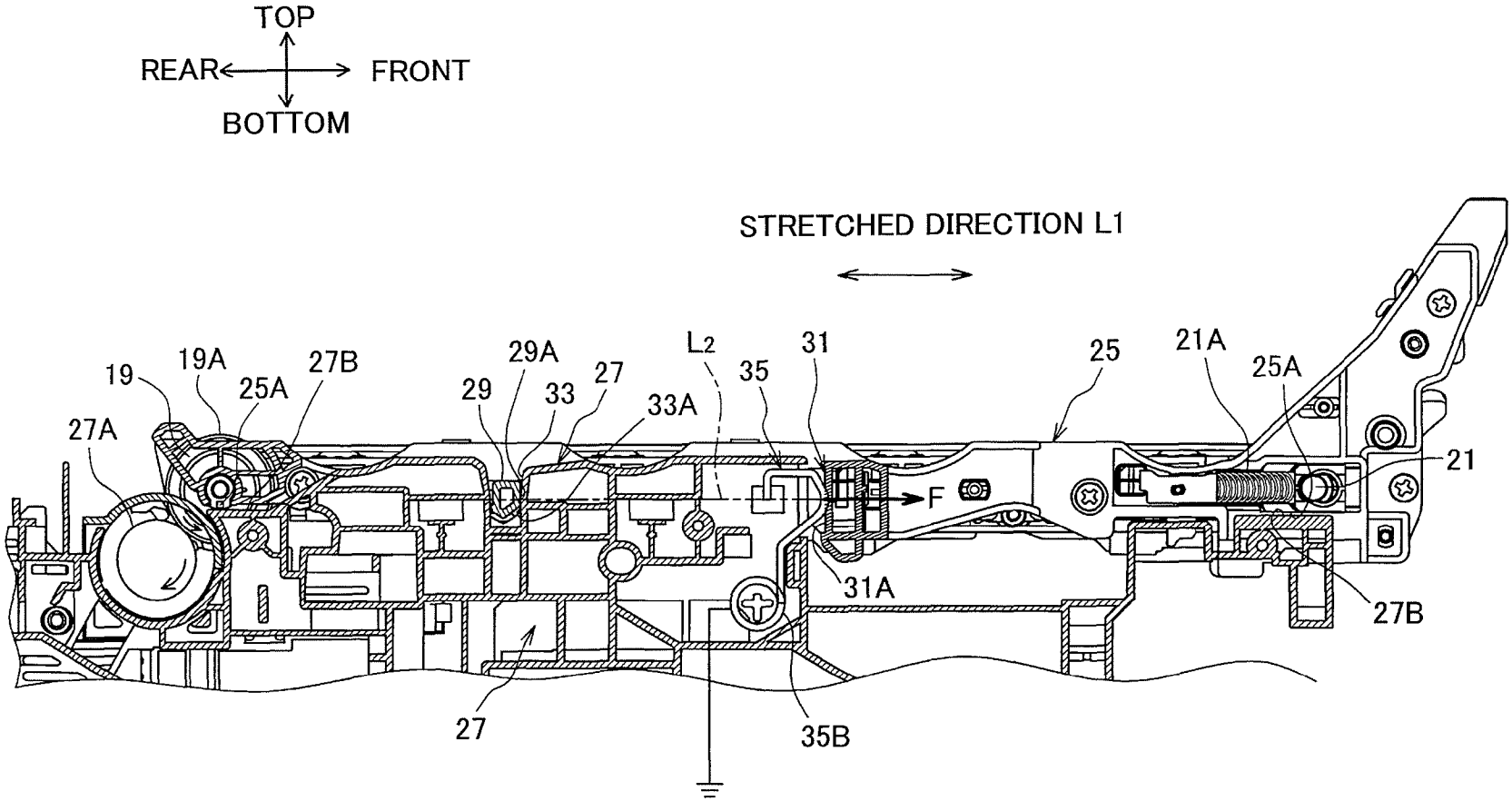
FIG. 5 is a cross-sectional side view showing a state where the belt unit is assembled to the chassis in the image forming apparatus according to the first embodiment.
Figure 6:
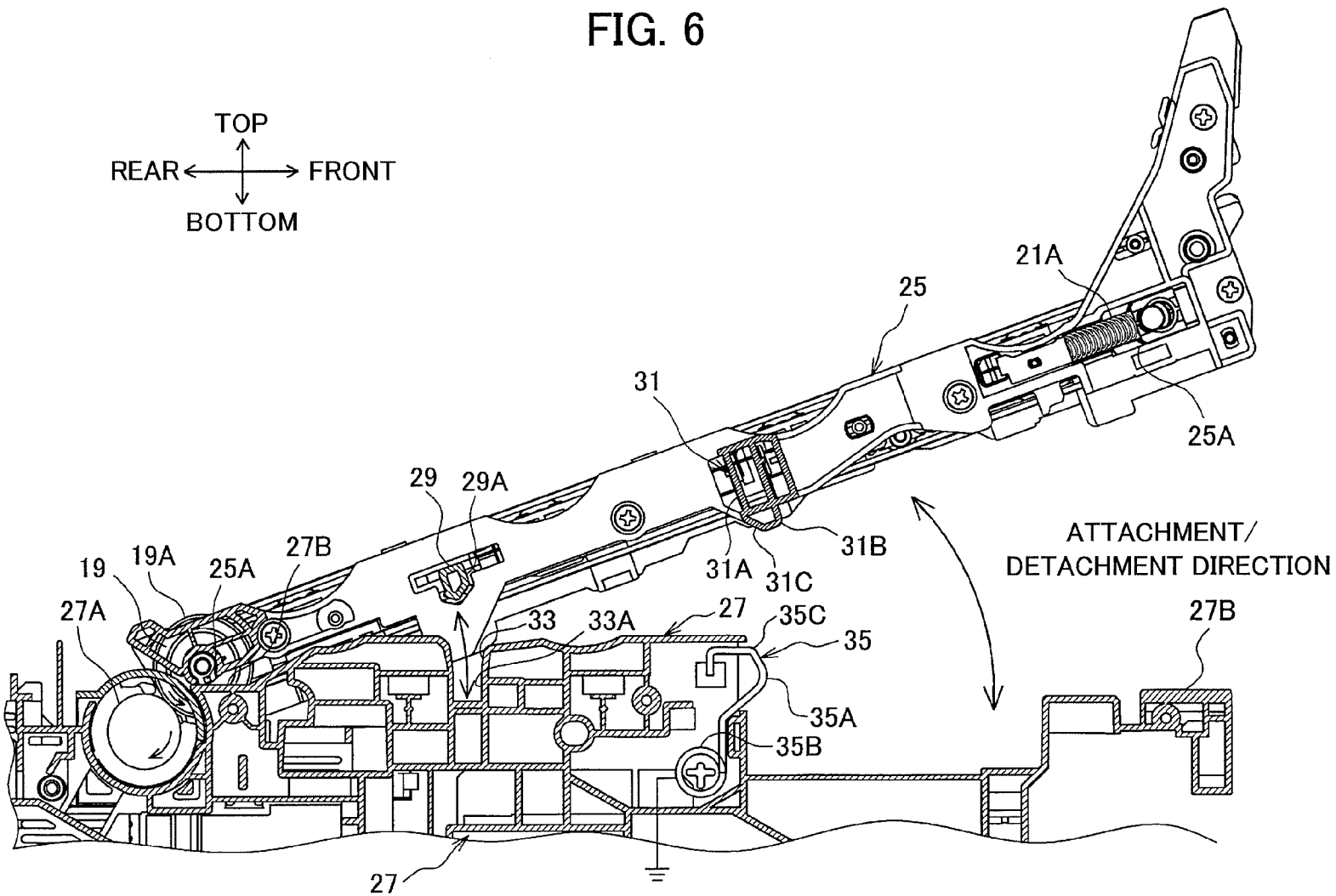
FIG. 6 is a cross-sectional side view showing a state where the belt unit is moved to be assembled to or detached from the chassis in the image forming apparatus according to the first embodiment.

On the other hand, as shown in FIGS. 5 and 6, the support frame 27 has a recessed first abutment portion 33 and a pressing portion 35.

The first abutment portion 33 is configured to be fitted or abutted with the first abutted portion 29. As shown in FIG. 6, the first abutment portion 33 is generally U-shaped in cross-section, in which two opposing walls (front and rear walls) define the recessed shape. One of the two opposing walls (front wall) is positioned closer to the pressed portion 31 than the remaining one of the two opposing wall (rear wall) to the pressed portion 31, and the one of the two opposing walls (front wall) has an inner surface functioning as a first abutment surface 33A.

Incidentally, the first abutted portion 29 has a first side (right side in FIG. 6) and a second side (left side in FIG. 6) opposing the first side. The first side is positioned closer to the pressed portion 31 than the second side to the pressed portion 31, and the first side provides a first abutted surface 29A. Upon fitting the first abutted portion 29 with the first abutment portion 33, the first abutment surface 33A is in abutment with the first abutted surface 29A.

The pressing portion 35 is configured to be in contact with the pressed portion 31 (pressed surface 31A) when the belt unit 25 is attached to the pair of support frames 27, i.e., when the first abutted portion 29 is brought into abutment with the first abutment portion 33. The pressing portion 35 is made from a resiliently deformable member such as a metal spring. More specifically, as shown in FIG. 6, the pressing portion 35 is provided by a torsion coil spring whose base end portion is fixed to the support frame 27. The pressing portion 35 has a triangular-shaped contact portion 35A to be in contact with the pressed surface 31A when the belt unit 25 is attached to the pair of support frames 27. The pressing portion 35 is thus configured to urge the pressed portion 31 (pressed surface 31A) toward the follower roller 21.

As shown in FIG. 5, when the pressed portion 31 is applied with a pressing force F from the pressing portion 35 as a result of attachment of the belt unit 25 to the pair of support frames 27, the first abutted portion 29 is pressed against the first abutment portion 33 so as to increase contacting surface pressure between the first abutment surface 33A and the first abutted surface 29A. Thus, a position of the belt unit 25 in the stretched direction L1 relative to the pair of support frames 27 can be fixed.

Further, the first abutment portion 33, the first abutted portion 29, the pressing portion 35, and the pressed portion 31 are designed such that an imaginary line passing through a contacting position between the first abutment portion 33 and the first abutted portion 29 and through a contacting position between the pressing portion 35 and the pressed portion 31 extends in a direction L2 (FIG. 5) parallel to the stretched direction L1. This direction L2 will be referred to as "positioning direction L2" hereinafter.

The contacting position between the first abutment portion 33 and the first abutted portion 29 implies a position on a contacting portion therebetween at which the contacting surface pressure is the largest in the contacting position. Alternatively, the contacting position implies a position on a central portion of the contacting portion between the first abutment portion 33 and the first abutted portion 29. In the same way, the contacting position between the pressing portion 35 and the pressed portion 31 implies a position on a contacting portion therebetween at which the contacting surface pressure is the largest in the contacting position. Alternatively, the contacting position implies a position on a central portion of the contacting portion between the pressing portion 35 and the pressed portion 31.

The pressing portion 35 is electrically grounded. Accordingly, each neutralization member 17 is electrically grounded through the pressing portion 35 and the pressed portion 31 when the pressed surface 31A is brought into contact with the pressing portion 35 as a result of attachment of the belt unit 25 to the pair of support frames 27.

Further, as shown in FIGS. 5 and 6, each of the side frames 23B, 23C has longitudinal end portions (front and rear end portions), and each of the longitudinal end portions is formed with a second abutted portion 25A. On each support frame 27, on the other hand, a second abutment portion 27B is formed on each end portion of the support frame 27 in the stretched direction L1. Each second abutment portion 27B is brought into contact with each abutted portion 25A when the belt unit 25 is attached to the pair of support frames 27, as will be described later.

Upon contact of each second abutted portion 25A with each second abutment portion 27B, the belt unit 25 is subjected to positioning relative to the support frames 27 in a direction perpendicular to the stretched portion 13A.

Incidentally, the direction perpendicular to the stretched portion 13A, i.e., a normal direction to the stretched portion 13A is coincident with the vertical direction, and the stretched direction L1 is coincident with horizontal direction. Thus, upon contact of each second abutted portion 25A with each second abutment portion 27B, vertical position of the belt unit 25 relative to the pair of support frames 27 is fixed.

Further, lateral position of the belt unit 25, i.e., a position in a direction perpendicular to the normal direction and the stretched direction L1 is fixed when the belt unit 25 is pressingly abutted to the left side frame 23C. To this effect, the right side frame 23B is provided with a spring (not shown) for urging the belt unit 25 toward the left side frame 23C. In the embodiment, this spring (not shown) also functions as an electrode for applying a voltage to the transfer portion 15.

The drive roller 19 and the follower roller 21 are rotatably supported to the side frames 23B and 23C. The rotating position of the drive roller 19 is fixed relative to the main frame 23A. On the other hand, the follower roller 21 is movable in the stretched direction L1 relative to the main frame 23A. An urging member 21A such as a coil spring is provided to urge the follower roller 21 in a direction away from the drive roller 19. Thus, in the present embodiment, the follower roller 21 functions as a belt tensioner for applying a predetermined tension to the stretched portion 13A.

Figure 7:
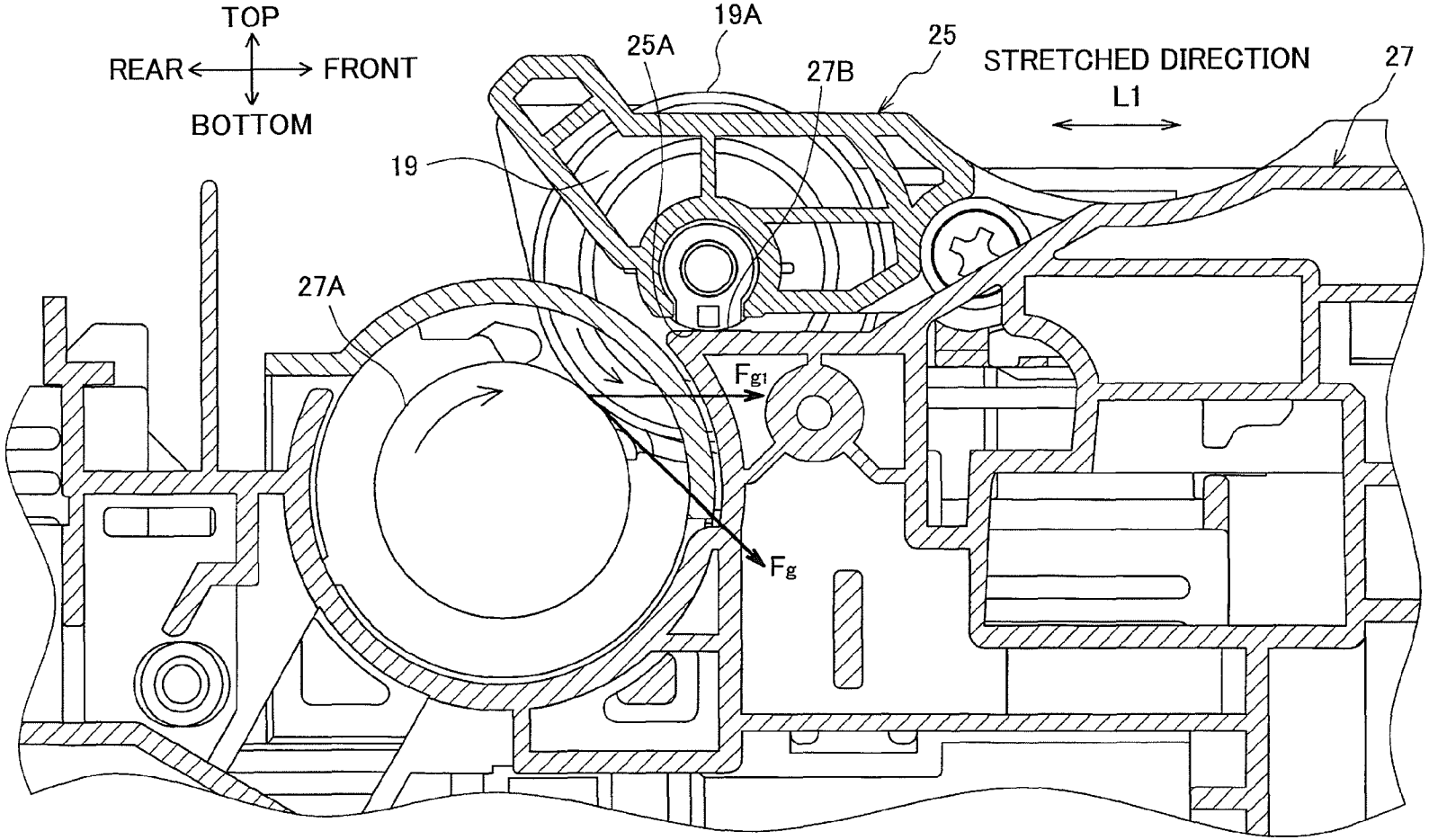
FIG. 7 is an enlarged partial cross-sectional view showing a meshing engagement of a roller gear in the belt unit and with a drive gear of the chassis in the image forming apparatus according to the first embodiment.

As shown in FIG. 2, the drive roller 19 has one axial end portion provided with a roller gear 19A rotatable integrally with the drive roller 19. On the other hand, as shown in FIG. 7, the support frame 27 is provided with a drive gear 27A meshingly engagable with the roller gear 19A so as to transmit driving force thereto. The drive gear 27A is rotatable by a driving force applied from an electric motor (not shown).

The meshing engagement between the drive gear 27A and the roller gear 19A generates a meshing engagement force Fg. The drive gear 27A is positioned such that the force Fg contains a force component Fg1 whose direction is coincident with that of the pressing force F of the pressing portion 35. As described above, the pressing force F is directed from the first abutted portion 29 to the pressed portion 31 (coincident with the positioning direction L2, see FIG. 5). Therefore, the drive gear 27A is so positioned that the force component Fg1 extending in a direction parallel to the stretched direction L1 can be directed from the first abutted portion 29 to the pressed portion 31.

2.2 Attachment and Detachment of the Belt Unit

The belt unit 25 is attached and removed relative to the support frames 27 in a direction (attachment/detachment direction), as shown in FIG. 6.

The base end portion of the pressing portion 35, which is fixed to the support frame 27, is a coil portion 35B. The pressing portion 35 has a free end portion resiliently deformable such that the free end portion is pivotally movable in the stretched direction L1 about the coil portion 35B.

The free end portion of the pressing portion 35 has the contact portion 35A to be in contact with the pressed portion 31 (pressed surface 31A), as described earlier. The free end portion has an end portion closer to the belt unit 25 than the contact portion 35A to the belt unit 25 as viewed in FIG. 6. The end portion has a guide portion having a guide surface 35C extending diagonally upward and rearward from the contact portion 35A. In other words, the guide surface 35C is inclined with respect the attachment/detachment direction of the belt unit 25 such that the guide surface 35C approaches toward the drive roller 19 as extending toward the belt unit 25.

On the other hand, the pressed portion 31 has a guide surface 31C closer to the pressing portion 35 than the pressed surface 31A to the pressing portion 35 as viewed in FIG. 6. The guide surface 31C is inclined with respect the attachment/detachment direction of the belt unit 25 such that the guide surface 31C approaches toward the follower roller 21 as extending toward the pressing portion 35.

For attaching the belt unit 25 to the support frames 27, as shown in FIG. 6, the second abutted portion 25A (left side in FIG. 6) closer to the drive roller 19 than the remaining abutted portion 25A (right side in FIG. 6) to the drive roller 19 is brought into contact with the corresponding second abutment portion 27B. While maintaining this contact state, the belt unit 25 is pivotally moved toward the support frames 27 i.e., downward about the left-side second abutted portion 25A. The attachment/detachment direction of the belt unit 25 may be defined as a direction in which the pressed portion 31 is pivotally moved about the drive roller 19 (or about the left-side second abutted portion 25A).

Thus, the guide surface 31C of the pressed portion 31 is slidingly moved relative to the guide surface 35C of the pressing portion 35. And at the same time, the pressing portion 35 is resiliently deformed toward the drive roller 19, and the first abutted portion 29 is brought into fitting engagement with the first abutment portion 33 as shown in FIG. 5.

The state shown in FIG. 5 where the first abutted portion 29 and the first abutment portion 33 are in contact with each other provides resilient deformation of the pressing portion 35 toward the drive roller 19 in comparison with a state shown in FIG. 6. Therefore in FIG. 5, the pressing force F is applied from the pressing portion 35 to the pressed portion 31.

On the other hand, for detaching the belt unit 25 from the support frames 27, the belt unit 25 is pivotally moved about the left-side second abutted portion 25A. That is, the belt unit 25 at the side of the follower roller 21 is moved away from the support frames 27, i.e., moved upward as shown in FIG. 6.

3. Feature of the image forming apparatus according to the first embodiment

According to the first embodiment, the pressing force F applied from the pressing portion 35 provides stable contact between the first abutment portion 33 and the first abutted portion 29, thereby performing positioning of the belt unit 25 relative to the support frames 27 in the stretched direction L1. Further, this pressing force F also provides electrical connection between the belt unit 25 and the casing 3 through the pressing portion 35 and the pressed portion 31.

Therefore, enhanced positioning of the belt unit 25 can result and electrical connection between the belt unit 25 and the casing 3 can be made without using additional or supplemental components. Further, according to the first embodiment, the positioning direction L2 is parallel to the stretched direction L1. The term "parallel" should not be strict, but "substantially parallel" by visual evaluation is sufficient.

With this structure, positioning of the belt unit 25 in the stretched direction L1 can be performed with high accuracy. That is, in the direct tandem type printer, developing agent images are transferred onto the sheets carried on the transfer belt 13. Here, vibration of the belt unit 25 may easily occur due to impacting force of the sheet entering on the transfer belt 13. The vibration of the belt unit 25 may cause positional displacement of the belt unit 25.

According to the first embodiment, since the positioning direction is parallel to the stretched direction L1, almost all the pressing force F for pressing the pressed portion 31 is utilized as a force for increasing contacting surface pressure between the first abutment portion 33 and the first abutted portion 29. Therefore, stable contact between the first abutment portion 33 and the first abutted portion 29 will provide stable positioning to the belt unit 25.

Further, according to the first embodiment, the first abutment portion 33, the first abutted portion 29, the pressing portion 35, and the pressed portion 31 are all positioned at the same side in the axial direction of the photosensitive drum 7A. Therefore, rotational moment in the vertical direction (normal direction) applied to the belt unit 25 can be reduced or minimized Thus, positioning to the belt unit 25 can be ensured.

That is, assuming that the first abutment portion 33 and the first abutted portion 29 are positioned at one side in the axial direction whereas the pressing portion 35 and the pressed portion 31 are positioned at another side in the axial direction, rotational moment in the vertical direction applied to the belt unit 25 will be increased. Accordingly, the moving direction of the stretched portion 13A is not perpendicular to the axial direction of the photosensitive drum 7A, so that a risk of inclination of the belt unit 25 may be escalating.

In contrast, according to the first embodiment, since the first abutment portion 33, the first abutted portion 29, the pressing portion 35, and the pressed portion 31 are all positioned at the same side in the axial direction of the photosensitive drum 7A, the above-described rotational moment can be reduced, thereby restraining inclination of the belt unit 25.

Further, according to the first embodiment, the pressed portion 31 includes the protruding portion 31B integrally molded with the side frame 23C, and the metal cover plate having the pressed surface 31A positioned to contact the pressing portion 35. Therefore, the pressed portion 31 can be produced at a lower cost in comparison with a case where the pressed portion 31 is made from a metal in its entirety, yet ensuring electrical connection to the support frame 27.

Further, according to the first embodiment, the drive gear 27A is so positioned that the force Fg transmitted from the drive gear 27A to the roller gear 19A contains the force component Fg1 directing in a direction the same as the direction of the pressing force F of the pressing portion 35 (i.e., parallel to the stretched direction L1).

Therefore, upon rotation of the drive gear 27A, not only the pressing force F from the pressing portion 35 but also the pressing force Fg1 generated by the rotation of the drive gear 27A are applied to the pressed portion 31. Accordingly, stabilized positioning of the belt unit 25 can be provided, and surface pressure contact between the pressing portion 35 and the pressed portion 31 is increased to thus reduce electrical contact resistance, thereby ensuring reliable electrical conductivity.

Further, according to the first embodiment, since the pressing portion 35 has the guide surface 35C inclined with respect to the attaching/detaching direction of the belt unit 25, attachment and detachment of the belt unit 25 is facilitated.

<Second Embodiment>

Figure 8:
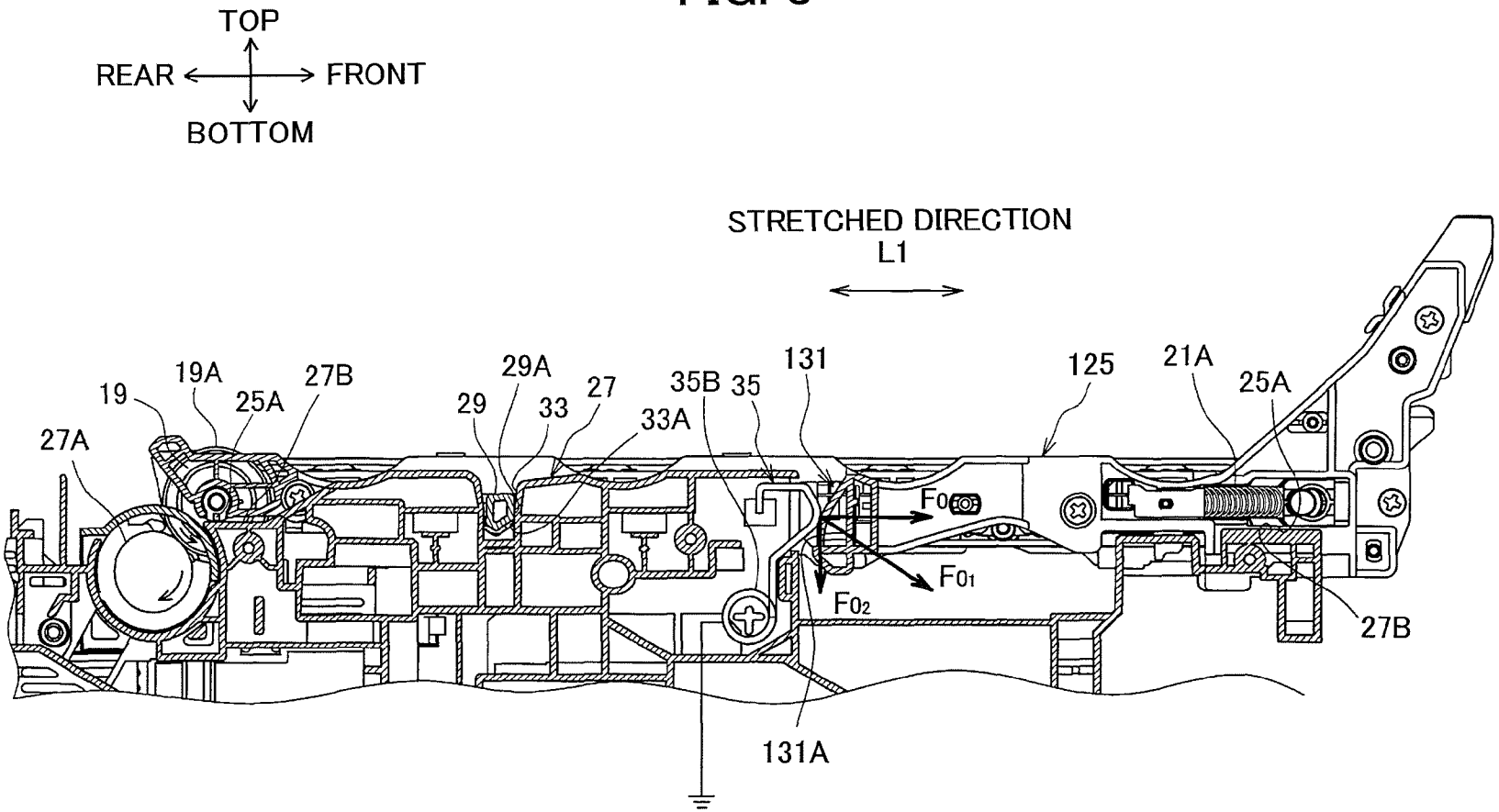
FIG. 8 is a cross-sectional side view showing a state where a belt unit is assembled to a chassis in an image forming apparatus according to a second embodiment of the present invention.

An image forming apparatus according to a second embodiment of the present invention will be described with reference to FIG. 8. Like parts and components are designated by the same reference numerals with those of the first embodiment to avoid duplicating description.

A belt unit 125 according to the second embodiment is provided with a pressed surface 131A, instead of the pressed surface 31A of the first embodiment.

The pressed surface 31A according to the first embodiment extends in a direction perpendicular to the plane parallel to the stretched portion 13A or perpendicular to the stretched direction L1. In contrast, the pressed surface 131A of the second embodiment is inclined with respect to the stretched direction L1 such that the pressed surface 131A extends toward the follower roller 21 in accordance with an approach of the pressed surface 131A toward the stretched portion 13A.

With this structure, a component of force Fo2 in the normal direction is generated by a pressing force Fo from the pressing portion 35. Therefore, in the second embodiment, positioning of the belt unit 125 in the stretched direction L1 and in the normal direction can be achieved. Incidentally, force Fo1 is a component of the pressing force Fo, and extends in a direction perpendicular to the pressed surface 131A. The force Fo2 is a component of the force Fo1, and extends in the normal direction.

<Third Embodiment>

Figure 9:
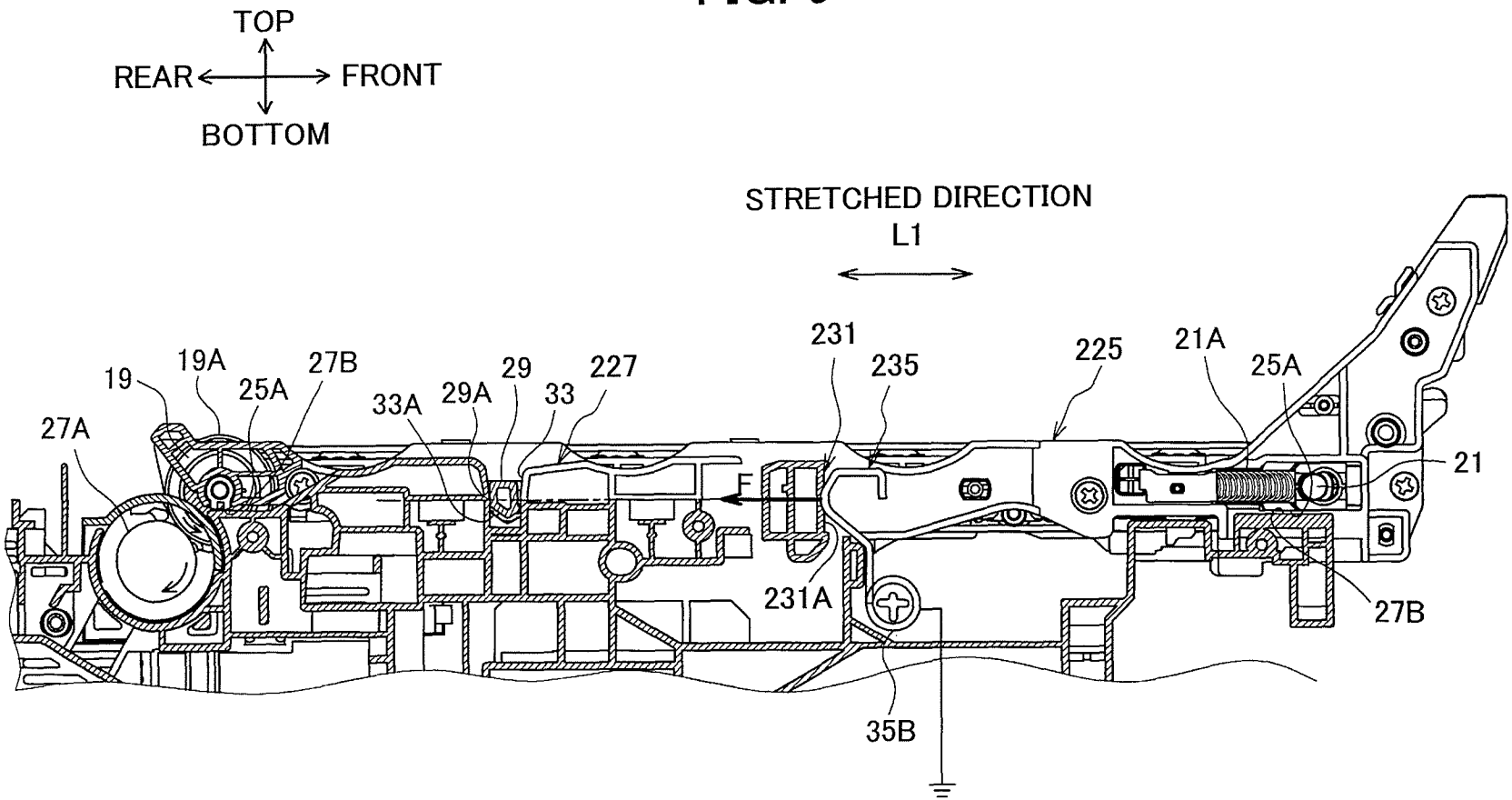
FIG. 9 is a cross-sectional side view showing a state where a belt unit is assembled to a chassis in an image forming apparatus according to a third embodiment of the present invention.

FIG. 9 shows an image forming apparatus according to a third embodiment of the present invention. In the foregoing embodiments, direction of the pressing force F from the pressing portion 35 and moving direction of the stretched portion 13A are opposite to each other, whereas in the third embodiment, the direction of the pressing force F is identical to the moving direction.

A belt unit 225 of the third embodiment includes a pressing portion 235 configured to bias a pressed portion 231 formed on a support frame 227 rearward (i.e., in a direction opposite to the moving direction of the stretched portion 13A). The pressed portion has a pressed surface 231A.

Conceivably, in accordance with circular movement of the transfer belt 13, a force (external force) directing in the direction the same as the moving direction of the stretched portion 13A may be applied to the belt unit 25. If the external force is excessive, such external force may affect positioning of the belt unit 25. Such external force becomes excessively large if a peripheral speed (circumferential speed) of the photosensitive drum 7A is greater than a moving speed of the stretched portion 13A.

Taking the above into consideration, according to the third embodiment, the direction of the pressing force F from the pressing portion 235 is identical to the moving direction of the stretched portion 13A. Therefore, the external force applied to the belt unit 25 is directed so as to increase contact surface pressure between the pressing portion 235 and the pressed portion 231. Consequently, the external force does not affect positioning to the belt unit 25.

Various Modifications are Conceivable.

For example, the foregoing embodiments pertain to the image forming unit 5 of the direct tandem type. However, the present invention is also available for an intermediate image transfer type image forming unit where developing agent images are superposedly transferred onto a transfer belt, and then, the superposed image is transferred onto the sheet from the transfer belt.

According to the intermediate image transfer type, vibration may occur in a belt unit by the contact of photosensitive drums with the transfer belt. Therefore, the present invention is particularly available for such type of image forming unit because of the sufficient positioning to the belt unit.

Further, in the second embodiment, the pressed surface 131A is inclined with respect to the stretched direction L1. Further, the pressed surface 131A may also be inclined with respect to the axial direction of the drive roller 19. In the latter case, pressing force in both stretched direction L and axial direction can be increased to further stabilize positioning of the belt unit.

Further, the second embodiment and the third embodiment can be combined together.

Further, in the foregoing embodiments, the neutralization member 17 is electrically grounded through the pressing portion 35, 135, 235 and the pressed portion 31, 131, 231. However, the pressing portion and the pressed portion can be used as a power supply portion to the transfer portion 15.

Further, in the foregoing embodiments, the pressing portion 35, 135, 235 is provided at the support frame 27, 227, whereas the pressed portion 31, 131, 231 is provided at the belt unit 25, 125, 225. As an alternative, the pressing portion 35, 135, 235 can be provided at the belt unit 25, 125, 225, and the pressed portion 31, 131, 231 can be provided at the support frame 27, 227.

Further, in the foregoing embodiments, the plurality of exposure units 9 employs arrayed LEDs for exposing the corresponding plurality of photosensitive drums 7A to light. However, an exposure unit using laser (so-called "laser scanner") is also available.

While the invention has been described in detail with reference to the embodiments thereof, it would be apparent to those skilled in the art that various changes and modifications may be made therein without departing from the spirit and scope of the invention.

What is claimed is:

1. An image forming apparatus comprising:

a photosensitive drum configured to carry thereon a developing agent image;

a stationary support frame having a first abutment portion; and a belt unit configured to be attached to and detached from the support frame, the belt unit comprising a transfer unit configured to transfer the developing agent image carried on the photosensitive drum to a target, and an endless belt circularly movable and positioned between the transfer unit and the photosensitive drum, wherein the belt unit has a first abutted portion configured to be in contact with the first abutment portion so as to perform positioning of the belt unit with respect to the support frame, one of the support frame and the belt unit having a pressing portion, and remaining one of the support frame and the belt unit having a pressed portion pressed by the pressing portion so as to increase a contacting surface pressure between the first abutment portion and the first abutted portion; and wherein the pressing portion has a first contacting portion configured to be in contact with the pressed portion, and the pressed portion has a second contacting portion configured to be in contact with the first contacting portion, the first contacting portion and the second contacting portion being made from an electrically conductive material.

2. The image forming apparatus as claimed in claim 1, wherein the endless belt has a stretched portion in direct confrontation with the photosensitive drum, a tensile force extending in a direction being generated at the stretched portion; and wherein the first abutment portion and the first abutted portion define a first mutual contacting position, and the pressing portion and the pressed portion define a second mutual contacting position; and wherein assuming that a direction in parallel with the direction of the tensile force is referred to as a stretched direction, and assuming that a direction passing through the first mutual contacting portion and the second mutual contacting portion is referred to as a positioning direction, the stretched direction being parallel to the positioning direction.

3. The image forming apparatus as claimed in claim 1, wherein the endless belt has a stretched portion in direct confrontation with the photosensitive drum; and wherein the second contacting portion is inclined with respect to the stretched portion.

4. The image forming apparatus as claimed in claim 3, wherein the support frame has a second abutment portion; and wherein the belt unit has a second abutted portion configured to be in contact with the second abutment portion for positioning the belt unit with respect to the support frame; and wherein a tensile force extending in a direction is generated at the stretched portion and assuming that a direction in parallel with the direction of the tensile force is referred to as a stretched direction and a direction perpendicular to the stretched direction is referred to as a normal direction, the first abutment portion and the first abutted portion are configured to perform positioning of the belt unit in the stretched direction, and the second abutment portion and the second abutted portion are configured to perform positioning of the belt unit in the normal direction; and wherein the second contacting portion is a surface that is inclined so as to generate a force component in the normal direction.

5. The image forming apparatus as claimed in claim 1, wherein the photosensitive drum defines an axis extending in an axial direction; and wherein the first abutment portion, the first abutted portion, the pressing portion, and the pressed portion are positioned at a same side as one another in the axial direction of the photosensitive drum.

6. The image forming apparatus as clamed in claim 1, wherein the belt unit further comprises a frame made from a resin; and wherein the pressed portion comprises a protruding portion protruding integrally from the frame, and a cover plate made from a metal positioned to cover at least the second contacting portion.

7. The image forming apparatus as claimed in claim 1, wherein the first contacting portion applies a pressing force to the second contacting portion in a pressing direction;

wherein the belt unit further comprise a drive roller configured to drive the endless belt, and a roller gear rotatable integrally with the drive roller; and wherein the support frame has a drive gear configured to be in meshing engagement with the roller gear for transmitting a driving force to the drive roller, the drive gear being so positioned that the driving force of the drive gear to the roller gear contains a force component directing in a direction identical to the pressing direction of the pressing force.

8. The image forming apparatus as claimed in claim 1, wherein the first contacting portion applies a pressing force to the second contacting portion in a pressing direction; and wherein the endless belt has a stretched portion in direct confrontation with the photosensitive drum, the stretched portion being moved in a direction identical to the pressing direction.

9. The image forming apparatus as claimed in claim 8, wherein the photosensitive drum provides a peripheral speed greater than a moving speed of the stretched portion.

10. The image forming apparatus as claimed in claim 1, wherein the belt unit further comprises a neutralization member for removing electrical potential from the endless belt, the neutralization member being electrically grounded through the pressing portion and the pressed portion.

11. The image forming apparatus as claimed in claim 1, wherein the belt unit is configured to be attached to and detached from the support frame in an attachment/detachment direction; and wherein the pressing portion comprises a spring member made from a metal, the pressing portion having a guide portion inclined with respect to the attachment/detachment direction.

* * * * *